US007443309B2

(12) United States Patent
Baldwin et al.

(10) Patent No.: US 7,443,309 B2
(45) Date of Patent: Oct. 28, 2008

(54) SELF TESTING GROUND FAULT CIRCUIT INTERRUPTER (GFCI)

(75) Inventors: John R. Baldwin, Bridgeport, CT (US); David Yu, Easton, CT (US); Nelson Bonilla, West Haven, CT (US)

(73) Assignee: Hubbell Incorporated, Orange, CT (US)

( * ) Notice: Subject to any disclaimer, the term of this patent is extended or adjusted under 35 U.S.C. 154(b) by 152 days.

(21) Appl. No.: 11/000,531

(22) Filed: Dec. 1, 2004

(65) Prior Publication Data

US 2006/0125622 A1 Jun. 15, 2006

(51) Int. Cl.
*G08B 21/00* (2006.01)

(52) U.S. Cl. ..... 340/650; 340/657; 340/635; 340/514; 361/42; 361/44; 361/45; 361/49; 361/50

(58) Field of Classification Search ..... 340/650, 340/657, 514, 635, 649, 654, 664; 361/42, 361/45, 49, 50, 71, 73, 93.1, 44; 324/709, 324/713

See application file for complete search history.

(56) References Cited

U.S. PATENT DOCUMENTS 4,618,907 A 10/1986 Leopold
5,418,678 A 5/1995 McDonald
5,594,398 A 1/1997 Marcou et al.
5,600,524 A 2/1997 Neiger et al.
5,661,623 A 8/1997 McDonald et al.
5,715,125 A 2/1998 Neiger et al.
6,052,265 A 4/2000 Zaretsky et al.
6,191,589 B1 2/2001 Clunn
6,262,871 B1 7/2001 Nemir et al.
6,407,893 B1 6/2002 Neiger et al.
6,421,214 B1 7/2002 Packard et al.
6,522,510 B1 2/2003 Finlay et al.
6,674,289 B2 1/2004 Macbeth
6,807,036 B2 * 10/2004 Baldwin ..... 361/42
6,850,394 B2 * 2/2005 Kim ..... 361/42
2002/0145838 A1 10/2002 Bonilla et al.
2002/0181175 A1 12/2002 Baldwin
2004/0004795 A1 1/2004 Chan et al.
2004/0004801 A1 1/2004 Bonilla et al.

* cited by examiner

*Primary Examiner*—Hung T. Nguyen
(74) *Attorney, Agent, or Firm*—Christian C. Michel; Mark S. Bicks; Alfred N. Goodman

(57) ABSTRACT

A self testing fault detector having a line side and a load side and a conductive path there between, said apparatus is provided. The self testing fault detector includes a controller, adapted to perform periodic status tests on a protection circuit of the self testing fault detector without interrupting power to the load.

31 Claims, 14 Drawing Sheets

= SERIAL PROGRAMMING CONNECTIONS

SELF TESTING GROUND FAULT CIRCUIT INTERRUPTER (GFCI)

CROSS-REFERENCE TO RELATED APPLICATIONS

Related subject matter is disclosed in U.S. Pat. No. 7,184,250, filed on, May 9, 2003, and assigned Ser. No. 10/434,101, entitled "GFCI THAT CANNOT BE RESET UNTIL WIRED CORRECTLY ON LINE SIDE AND POWER IS APPLIED," the entire contents of said application being incorporated herein by reference.

BACKGROUND OF THE INVENTION

1. Field of the Invention

The present invention relates generally to a self testing fault interrupting device, such as a ground fault circuit interrupter (GFCI). More particularly, the present invention relates to a self testing fault interrupting device where a periodic self test is performed on the fault detection and tripping portions of the device independent of a manual test.

2. Background of the Invention

Fault interrupting devices are designed to trip in response to the detection of a fault condition at an AC load. The fault condition can result when a person comes into contact with the hot side of the AC load and an earth ground, a situation which can result in serious injury. A ground fault circuit interrupter (GFCI) detects this condition by using a sense transformer to detect an imbalance between the currents flowing in the line and neutral conductors of the AC supply, as will occur when some of the current on the load hot side is being diverted to ground. When such an imbalance is detected, a relay or circuit breaker within the GFCI device is immediately tripped to an open condition, thereby removing all power from the load.

Many types of GFCI devices are capable of being tripped not only by contact between the line side of the AC load and ground, but also by a connection between the neutral side of the AC load and ground. The latter type of connection, which may result from a defective load or from improper wiring, is potentially dangerous because it can prevent a conventional GFCI device from tripping at the required threshold level of differential current when a line-to-ground fault occurs.

Prior art self testing fault protection devices typically provide a self test which replaces a user having to perform manual tests at fixed periods of time, for example, weekly, monthly, and so on. However, the self test involves the opening and closing of the GFCI's contacts. This can create a problem when sensitive equipment such as medical equipment is connected to the GFCI. The medical equipment cannot tolerate interruptions of a prolonged duration.

In addition, frequent testing is often necessary to insure the integrity of the GFCI. However, frequent testing often compounds the problem by increasing interruptions to sensitive equipment that is connected to the GFCI.

The performance of a manual test is an option on some GFCI protection devices. The user is required to press a test button which simulates a ground fault condition in GFCI protection devices resulting in the contacts of the GFCI protection devices opening. However, users usually forget or simply choose to ignore performing the manual tests.

An additional problem is that if the GFCI has a high cost, end users may select a lower cost GFCI that has the above mentioned problems without fully being aware of the disadvantages of the GFCI.

Therefore, a need exists for a self testing GFCI that is capable of providing periodic testing without interrupting the power supply to equipment that is connected to the GFCI. In addition, the GFCI device should preferably be low cost.

SUMMARY OF THE INVENTION

A self testing fault detector having a line side and a load side and a conductive path there between is provided. The self testing fault detector includes a solenoid, adapted to move a miswire prevention plate from a first position operable to prevent closure of at least one contact disposed in said collective path, to a second position operable to allow closure of the at least one contact when the self testing fault detector is powered from the line side in order to allow the closure of a plurality of contacts disposed in the conductive path, and a processor, adapted to perform a periodic self test to determine the status of the self testing fault detector.

A self testing fault detector having a line side and a load side and a conductive path there between, said apparatus is provided. The self testing fault detector includes a controller, adapted to perform periodic status tests on a protection circuit of the self testing fault detector without interrupting power to the load.

In an embodiment of the present invention, the controller provides an imbalance during negative half cycles of a sinusoidal input signal. The controller determines that the self testing fault detector is faulty an output signal from a GFCI chip is not detected.

In another embodiment of the present invention, the controller turns on a switching device to determine if a current flows in the switching device and determines the operability of the switching device by detecting a discharge of a capacitor when the switching device is on.

In still another embodiment of the present invention, the controller determines the operability of the solenoid by detecting a discharge of the capacitor during a negative half cycle of a sinusoidal input.

BRIEF DESCRIPTION OF THE DRAWINGS

These and other aspects, advantages and novel features of the invention will be more readily appreciated from the following detailed description when read in conjunction with the accompanying drawings, in which.

Throughout the claims, like reference numbers should be understood to refer to like elements, features and structures.

DETAILED DESCRIPTION OF THE EXEMPLARY EMBODIMENTS

Figure 1:
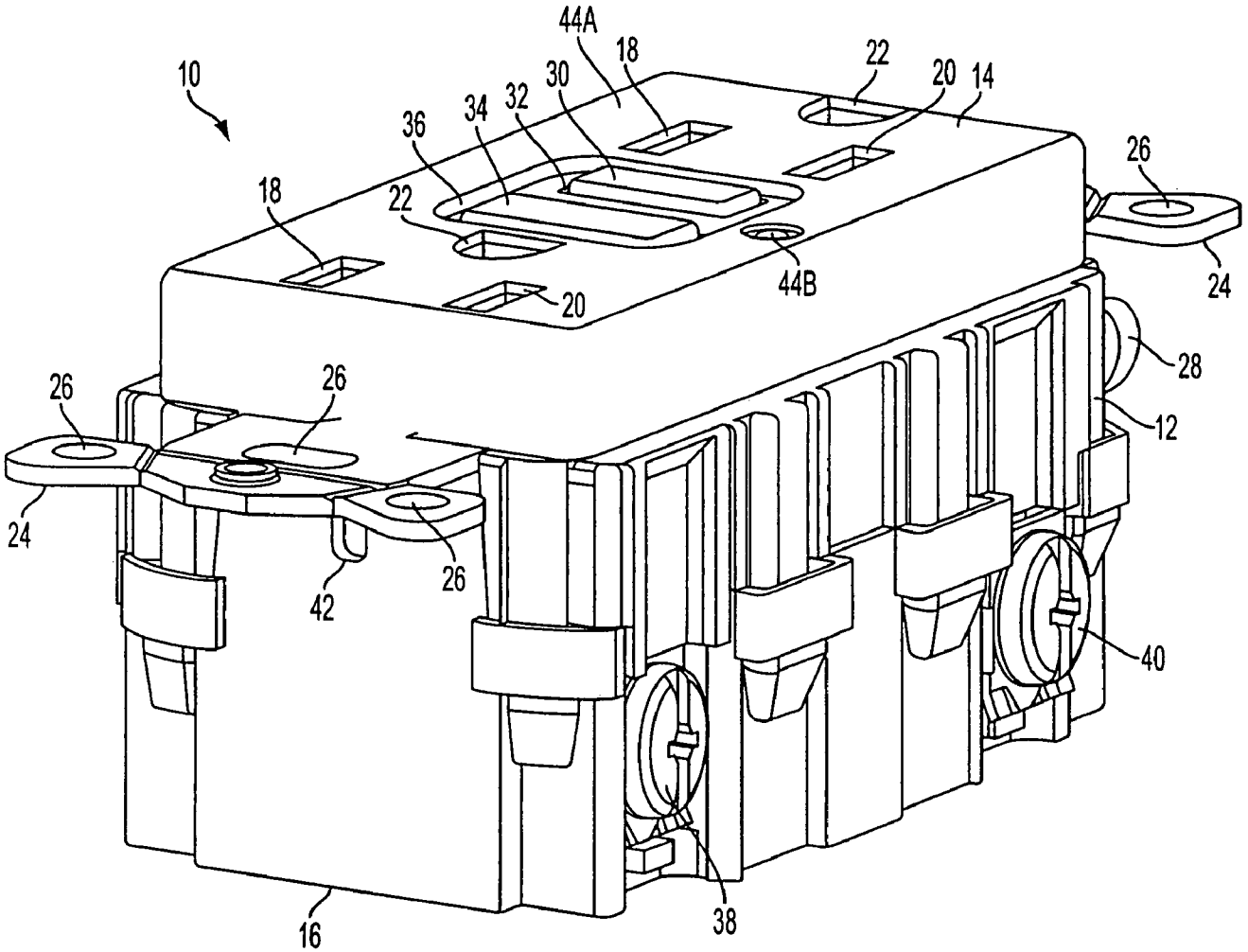
FIG. 1 is a perspective view of an example of a ground fault circuit interrupting (GFCI) device in accordance with an embodiment of the present invention.

FIG. 1 is a perspective view of an example of a ground fault circuit interrupting (GFCI) device 10 in accordance with an embodiment of the present invention. The GFCI device 10 comprises a housing 12 having a cover portion 14 and a rear portion 16. The GFCI also includes an inner housing 13 (See FIG. 4) when the cover portion 14 is removed from the rear portion 16. The cover portion 14 and rear portion are removably secured to each other via fastening means such as clips, screws, brackets, tabs and the like. The cover portion includes plugin slots (also known as face receptacles) 18 and 20 and grounding slots 22. It should be appreciated by those skilled in the art that plugin slots 18 and 20 and grounding slots 22 can accommodate polarized, non-polarized, grounded or non-grounded blades of a male plug. The male plug can be a two wire or three wire plug without departing from the scope of the embodiment of the present invention.

The GFCI receptacle 10 further includes mounting strap 24 having mounting holes 26 for mounting the GFCI receptacle 10 to a junction box (not shown). At the rear wall of the housing 12 is a grounding screw 28 for connecting a ground conductor (not shown).

A test button 30 extends through opening 32 in the cover portion 14 of the housing 12. The test button is used to activate a test operation that tests the operation of the circuit interrupting portion disposed in the GFCI receptacle 10. The circuit interrupting portion, to be described in more detail below, is used to break electrical continuity in one or more conductive paths between the line and load side of the GFCI receptacle 10. A reset button 34 extends through opening 36 in the cover portion 14 of the housing 12. The reset button 34 is used to activate a reset operation, which reestablishes electrical continuity in the open conductive paths.

Figure 2:
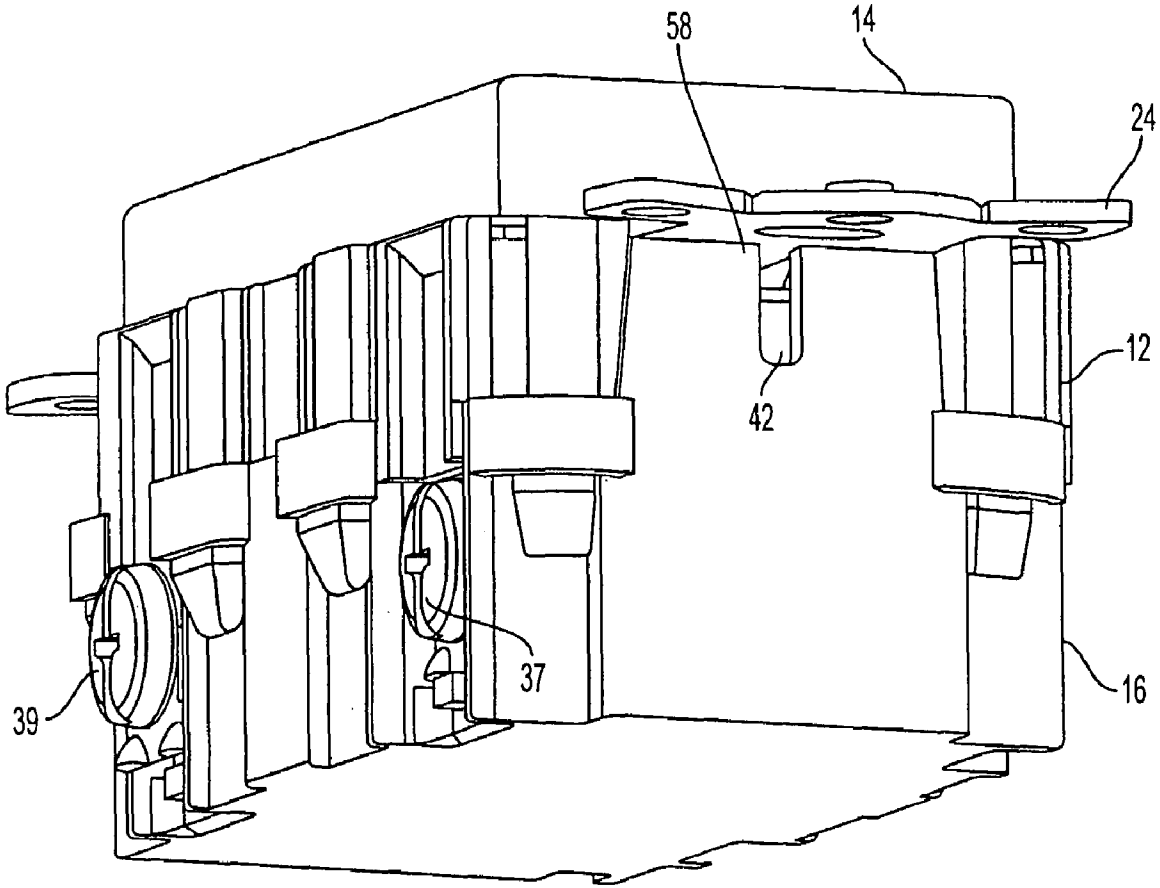
FIG. 2 is another perspective view of the ground fault interrupting device shown in FIG. 1 in accordance with an embodiment of the present invention.

Rear portion 16 preferably includes four screws, only two of which are shown in FIG. 1. Load terminal screw 38 is connected to a neutral conductor and an opposing load terminal screw 37 (See FIG. 2) is connected to the hot conductor. Line terminal screw 40 is connected to the neutral conductor and an opposing line terminal screw 39 (See FIG. 2) is connected to the hot conductor. It should be appreciated by those skilled in the art that the GFCI receptacle 10 can also include apertures proximate the line and load terminal screws 37, 38, 39 and 40 to receive the bare end of conductors rather than connecting the bare end of the wires to the line and load terminal screws.

In an embodiment of the present invention rear portion 16 also contains an aperture 42 (See FIG. 2) for accessing the internal portion of the GFCI receptacle 10 for testing during the manufacturing process. Specifically, the aperture 42 provides access to a miswire plate 58, the operation of which will be described in detail below. The aperture 42 is preferably sealed prior to shipping of the GFCI receptacle 10 to distributors.

Alarm indicator 44 preferably comprises a dual color lamp which provides a first color when a first filament is activated and a second color when a second filament is activated. In one embodiment of the present invention, the alarm indicator 44A illuminates to provide a green color when the GFCI receptacle 10 is operating normally and providing GFCI protection. In another embodiment of the present invention, the alarm indicator 44B illuminates to provide a flashing red color when the GFCI receptacle 10 is operating as a normal receptacle and not providing ground fault protection indicating a detected fault in the GFCI mechanism or electronics. Specifically, alarm indicator 44B flashes when any portion of the self test fails or fails a coil test. In another embodiment of the present invention, alarm indicator 44B illuminates steady to indicate that a ground fault was detected. It should be appreciated by those skilled in the art that although the alarm indicator is described as being a dual filament lamp, two separate single filament lamps, a single lamp having a single filament, or a buzzer, or any other suitable indicator such as a colored lamp can be used to provide an alarm indication without departing from the scope of the present invention.

Figure 3A:
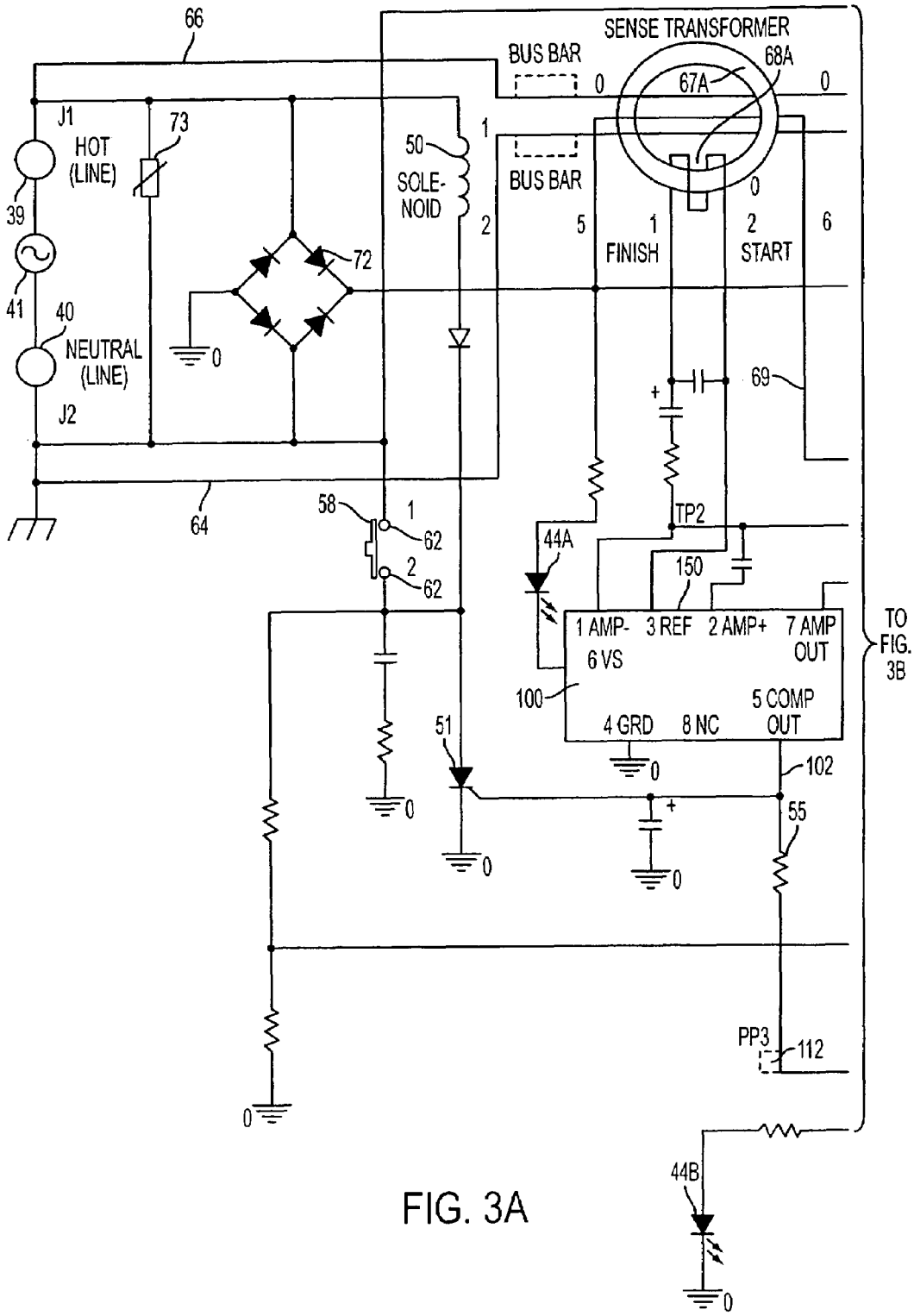
FIG. 3 is a schematic diagram of a ground fault circuit interrupter in accordance with an embodiment of the present invention, in which a conventional GFCI chip is employed in combination with a microprocessor to operate the GFCI.
Figure 3B:
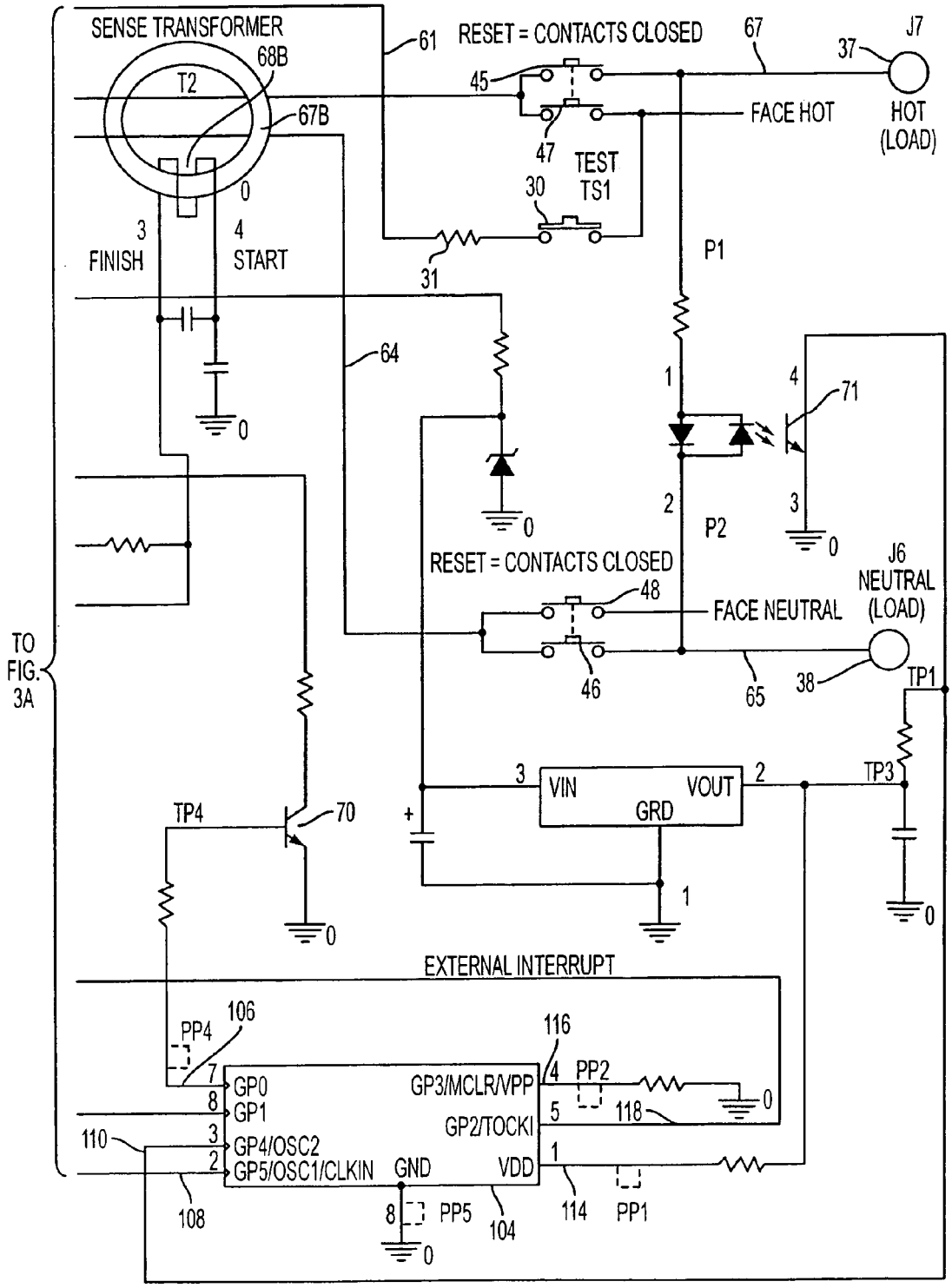

FIG. 3 is a schematic diagram illustrating an example of the circuitry of the ground fault circuit interrupting device of FIG. 1 in accordance with an embodiment of the present invention. In accordance with this embodiment, the GFCI device 10 is provided with a contacts 45, 46, 47, 48, a sensing circuit comprising a GFCI chip 100 and a transformer arrangement comprising sensing transformer 68A and ground transformer 68B, solenoid 50, solenoid plunger 52 (See FIGS. 4-9), latching plate 54 (See FIG. 7-9), reset pin 56 (See FIG. 7-9), miswire plate 58, locking spring 60, secondary contacts 62, neutral conductor 64, hot conductor 66 and a microprocessor 104.

GFCI device 10 is structured and arranged to prevent an initial miswiring of the GFCI. That is, as described in more detail below, prior to shipping the device for use, the miswire plate 58 is pressed downward to engage a projection 53 on the back of plunger 52 and makes contact with secondary contacts 62 to thus close the secondary contacts 62. In the GFCI device's initial configuration, the reset pin 56, when depressed, cannot engage the latching plate 54 because the latching plate 54 is displaced by the solenoid plunger 52 and the miswire plate 58, such that aperture 55 is aligned with reset pin 56 (See FIGS. 7-9). When the GFCI receptacle 10 is connected to the line side, the secondary contacts power the solenoid 50, causing solenoid plunger 52 to release miswire plate 58 and position latching plate 54 so that the reset pin 56 can engage with the edge of the latching plate 54 when the reset button 34 is depressed.

Figure 4:
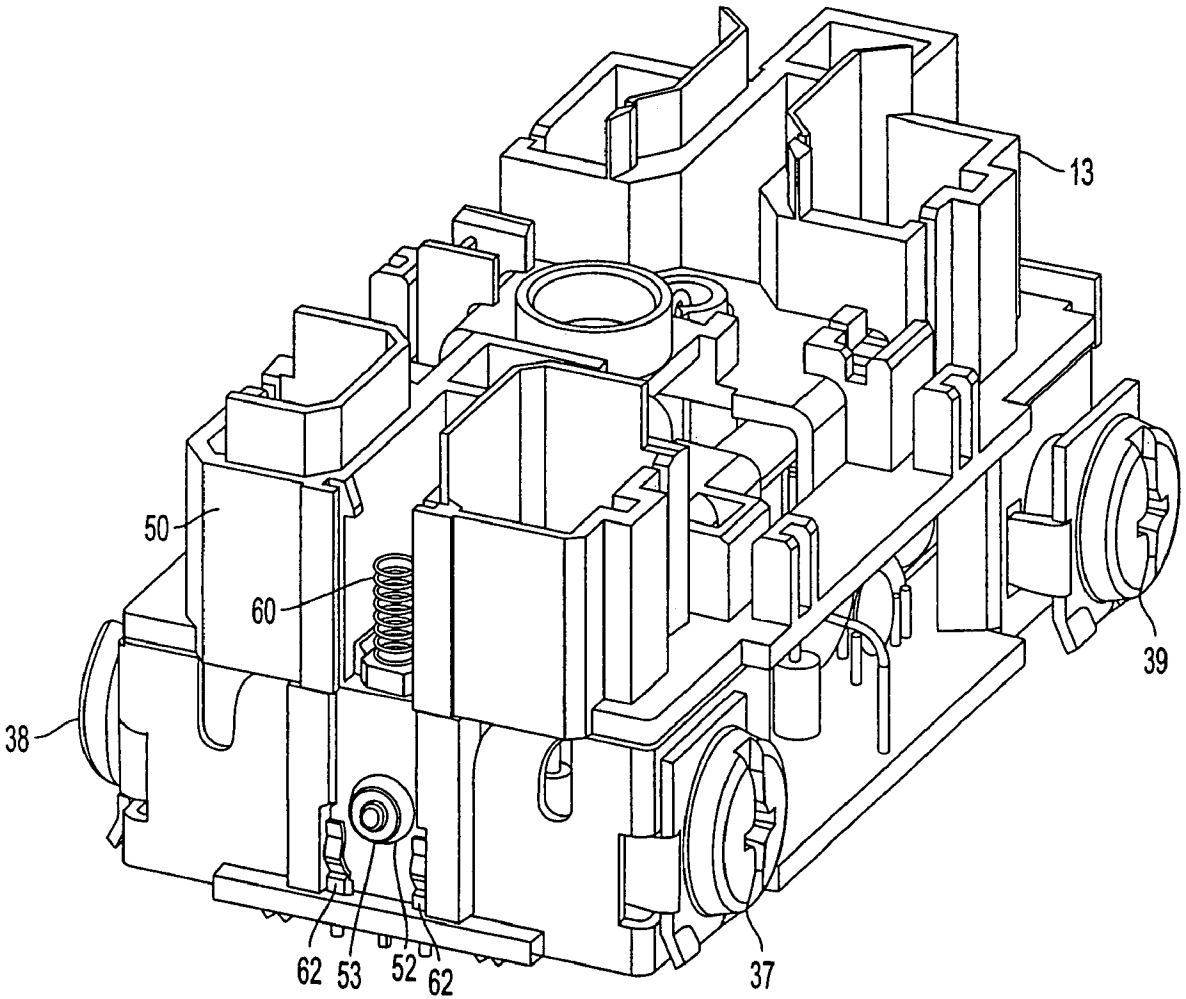
FIGS. 4-6 are perspective views illustrating the operation of a miswire plate of the ground fault circuit interrupting device shown in FIG. 1 in accordance with an embodiment of the present invention.
Figure 5:
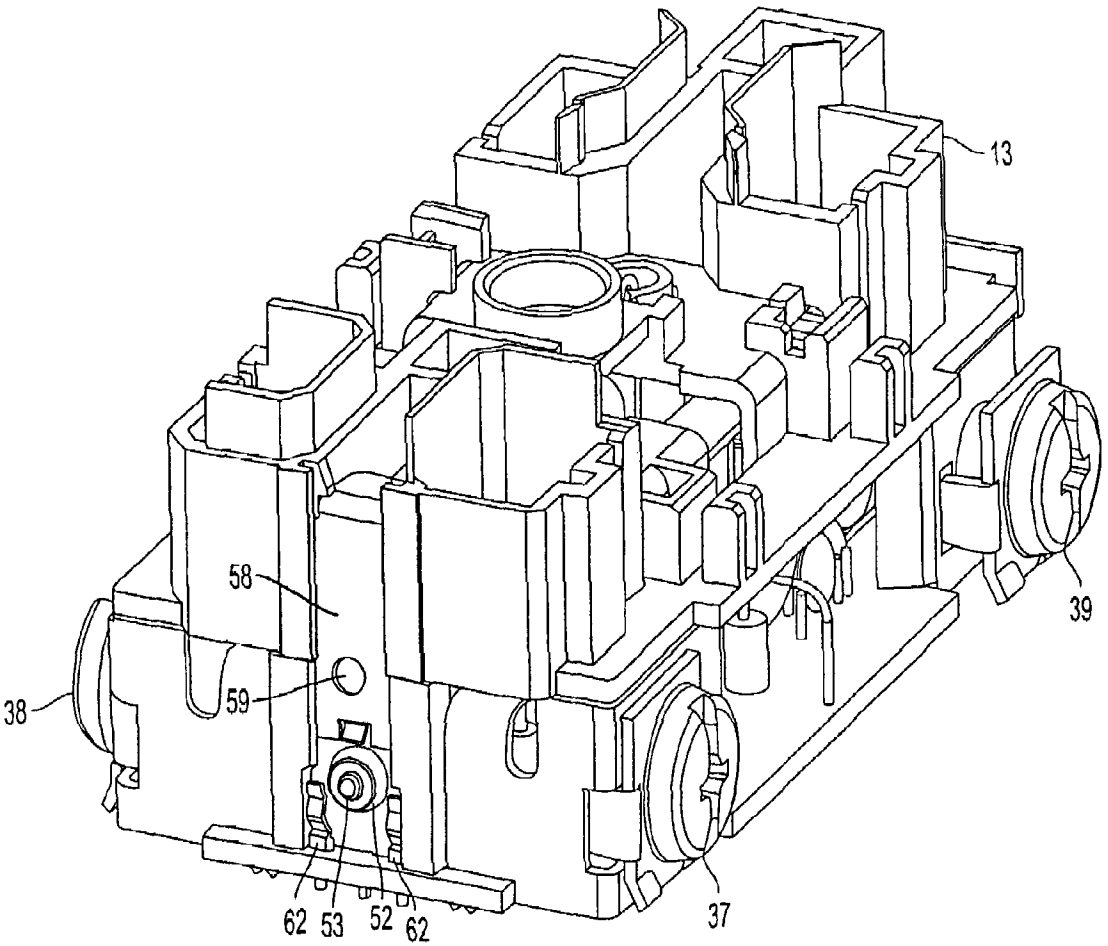
Figure 6:
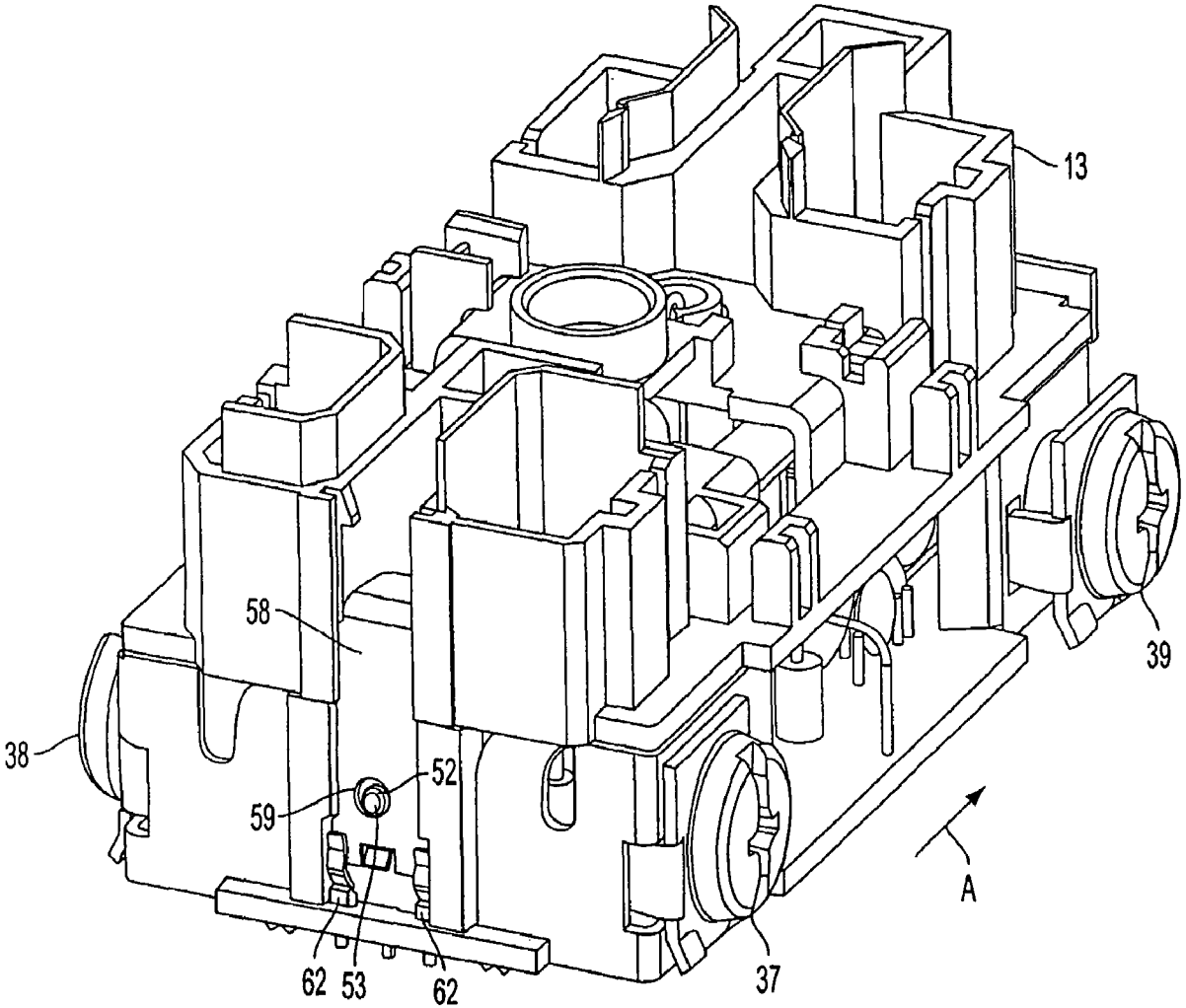

FIGS. 4-6 are perspective views illustrating examples of positions of the miswire plate 58 in accordance with an embodiment of the present invention. In FIG. 4 the cover portion 14 of the housing 12 is removed to expose the internal housing 13 of the GFCI 10. The locking spring 60, secondary contacts 62 and solenoid plunger 52 are shown. The locking spring 60 is shown in an extended or release position and is not exerting pressure in FIG. 4.

In FIG. 5, the miswire plate 58 is shown in a released or extended position. The locking spring 60 (See FIG. 4) holds the miswire plate 58 up, thus allowing plunger 52 to fully extend. In this position, an open circuit exists between the secondary contacts 62.

In FIG. 6, the miswire plate 58 is shown as being in the engaged position, which is also the position the GFCI device is shipped in. Projection 53 of the plunger 52 engages aperture 59 in miswire plate 58, and, holds miswire plate 58 in a miswire prevention position. In this position, miswire plate 58 closes the circuit between secondary contacts 62. That is, an aperture 59 in the miswire plate 58 interlocks with the projection 53 on the plunger 52 and holds the miswire plate 58 in a position in which the miswire plate 58 makes contact with and closes the secondary contacts 62. When the reset button 34 is depressed and the miswire plate 58 is in a locked state, the reset pin 56 cannot engage with the latching plate 54 because the plunger 52 positions the latching plate 54 such that the reset pin 56 passes through aperture 55 freely. The miswire plate 58 will remain in this position until the GFCI receptacle 10 is powered from the line side. As can be appreciated from the schematic in FIG. 3, the load terminals 37 and 38 are electrically isolated from the remainder of the circuit when the latching mechanism 46 is in the open state as shown in FIG. 4. However, as is also shown, the secondary contacts 62, when closed by the miswire plate 58, provide a path which enables the solenoid to be powered from the power source connected to the line terminals 39 and 40 and move the plunger 52 in the direction of "A", thereby removing the projection 53 of the plunger 52 from the aperture 59 and releasing the miswire plate 58. Accordingly, the spring 60 raises the miswire plate 58 upward and out of contact with secondary contacts 62, thus opening the secondary contacts 62.

Figure 7:
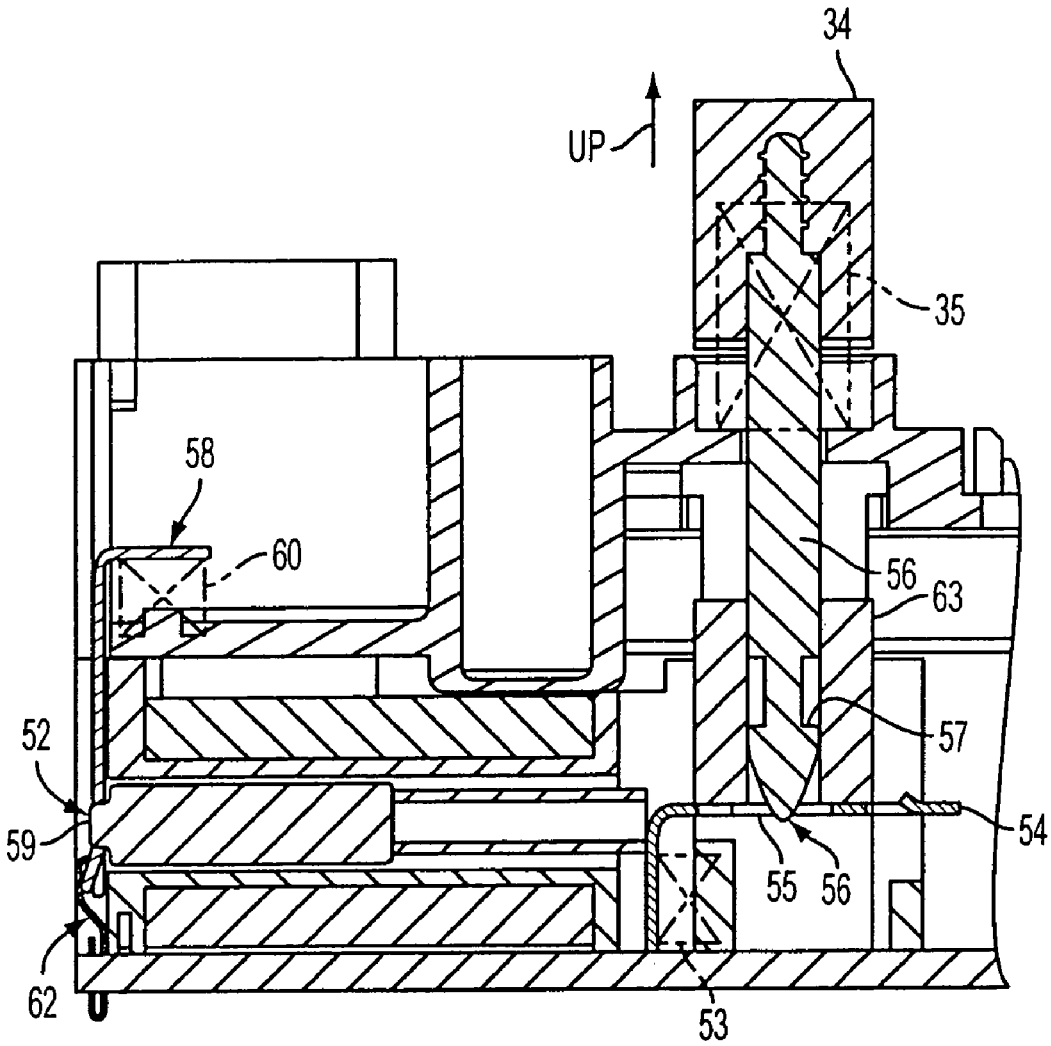
FIGS. 7-9 are cross sectional views illustrating examples of positions of the miswire plate, a latching plate and a reset pin of the ground fault circuit interrupting device of FIG. 1 in accordance with an embodiment of the present invention.
Figure 8:
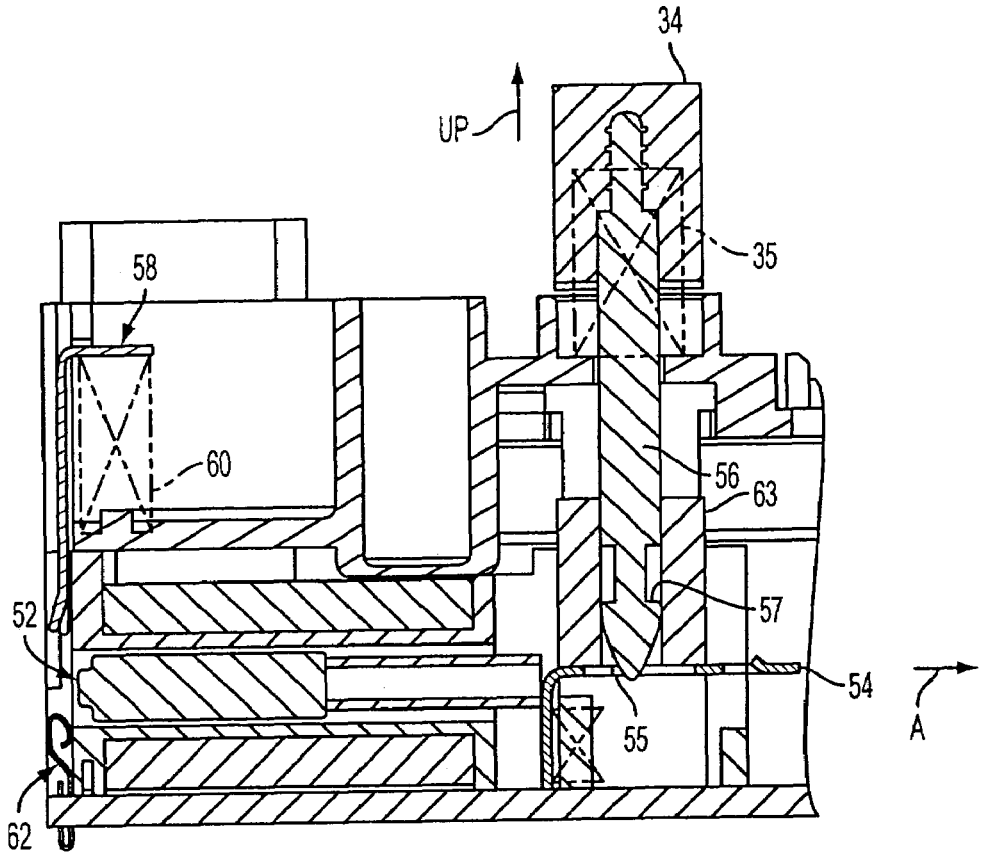
Figure 9:
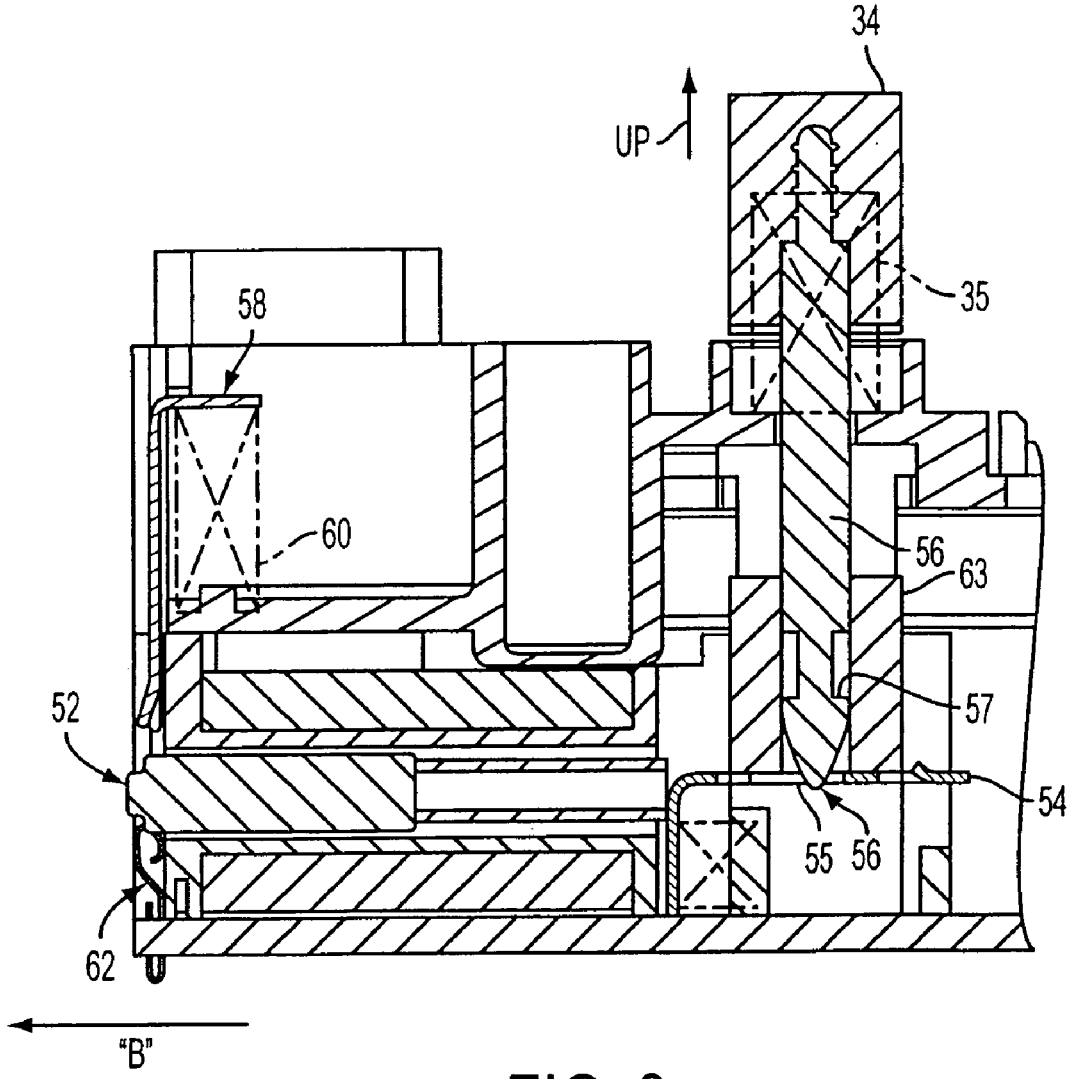

FIGS. 7-9 are cross sectional views illustrating examples of positions of the miswire plate 58, a latching plate 54 and a reset pin 56 in accordance with an embodiment of the present invention. In FIG. 7, the miswire plate 58 is shown as being engaged with the projection 53 of the plunger 52 via the aperture 59. The miswire plate 58 makes contact with secondary contacts 62, thus closing them. Locking spring 60 is compressed and exerts pressure against the miswire plate 58, but cannot move miswire plate 58 upwards because miswire plate 58 is held in place by projection 53 of solenoid plunger 52. In addition, latching plate 54 is positioned to prevent the reset pin 56 from engaging with the latching plate 54. That is, the latching plate 54 is positioned to allow the reset pin 56 to freely pass through the latching plate 54 when the reset button is depressed without engaging with the latching plate 54.

FIG. 8 illustrates the GFCI receptacle 10 after power is applied to the line side of the device when power is first applied. The secondary contacts 62 are closed, thus power is applied to the solenoid 50, which drives the plunger 52 forward in the direction of "A". This releases the projection 53 of the plunger 52 from the aperture 59 of the miswire plate 58, and also pushes the plunger 52 against the latching plate 54 to position the aperture 55 slightly out of alignment with the reset pin 56. The locking spring 60 urges the miswire plate 58 upward, thus forcing the miswire plate 58 into an extended or non-contacting position. The secondary contacts 62 open and remove power from the solenoid 50.

FIG. 9 illustrates the GFCI receptacle 10 with the miswire plate 58 in a non- engaged state and the latching plate 54 in an engagement position. Specifically, solenoid plunger 52 is free to move in the direction of "B". That is, the latch spring 53 pushes latch plate 54 and solenoid plunger 52 in the "B" direction. Because the solenoid plunger 52 can move further, latching plate 54 can move to an engagement position, such that reset pin 56 engages an edge of aperture 55 in the latching plate 54 when depressed. The GFCI receptacle is now able to provide ground fault protection.

It should be noted that since contacts 45, 46, 47 and 48 of FIG. 3 are shipped in an open position, if the power source is connected to the load terminals 37 and 38, there is no electrical continuity to the solenoid 50. Thus the solenoid 50 does not remove the solenoid plunger 52 from engagement with the miswire plate 58.

Referring now to FIG. 3 and the operation of the GFCI receptacle 10 in a ground fault state, FIG. 3 is a schematic diagram of a ground fault circuit interrupter in accordance with an embodiment of the present invention, in which a conventional GFCI chip 100 is employed in combination with a microprocessor 104 to operate the GFCI receptacle 10. The GFCI receptacle 10 employs a GFCI chip 100 with an output 102 connected to a pin 112 of the microprocessor 104. The microprocessor 104 is preferably a Type PIC12F629 or PIC12F675 microprocessor manufactured by Microchip, located in Chandler, Ariz.

The GFCI device 10 employs two sets of contacts, namely contacts primary hot and neutral contacts 45 and 46 and face hot and neutral contacts 47 and 48. Contact 45 establishes electrical continuity between line terminal 39 and load terminal 37 via hot conductor 66. Contact 46 establishes electrical continuity between line terminal 40 and load terminal 38 via neutral conductor 64. Face contacts 47 and 48 establish electrical continuity between the line terminals 39 and 40 and face terminals 18 and 20 via hot conductor 66 and neutral conductor 64, respectively. The isolation of face contacts 47 and 48 from the load terminals 37 and 38 prevent the face terminals 18 and 20 from being powered if the GFCI device 10 is mistakenly wired so that power source 41 is connected to the load terminals 37 and 38. It should be noted that GFCI device 10 is structured and arranged to permit the electronics of the circuit to be powered only when the GFCI device 10 is wired from the line terminals 39 and 40 via a power source. If a power source 41 is connected to the load terminals 37 and 38, the electronics of the GFCI device 10 cannot be powered, and the miswire plate 58 cannot be released in order to close contacts 45, 46, 47 and 48, which are mechanically closed by the reset button 34. Before initial power is applied contacts 45, 46, 47 and 48 are open. The microprocessor 104 detects an output from the optocoupler 77 only when contacts 45 and 46 are closed, which can only occur after the GFCI device has been properly connected on the line side (that is, after the miswire plate 58 has been closed).

The detection of a ground fault condition at a load connected to one of the face receptacles 18, 20 or to the load terminals 37 and 38, is implemented by a current sense transformer 68A, and the GFCI chip 100 as well as other interconnecting components. The GFCI chip 100 is preferably a Type RV4145N integrated circuit. The GFCI chip 100 and the microprocessor 104 are powered from the line terminals 39 and 40 by a full-wave bridge rectifier 72. A transient voltage suppressor 73 is preferably connected across the line terminals 39 and 40 to provide protection from voltage surges due to lightning and other transient conditions. As the transients increase, the voltage suppressor 73 absorbs energy.

Within the GFCI receptacle 10, the hot conductors 66 and 67, as mentioned above, connect the line terminal 39 to the load line terminal 37, and neutral conductors 64 and 65 connect the line terminal 40 to the load terminal 38, in a conventional manner when contacts 45 and 46 are closed. The conductors 66 and 64 pass through the magnetic cores 67A and 67B of the two transformers 68A and 68B, respectively. The transformer 68A serves as a differential sense transformer for detecting a leakage path between the line side of the AC load and an earth ground (not shown), while the transformer 68B serves as a grounded neutral transformer for detecting a leakage path between the neutral side of the AC load and an earth ground. In the absence of a ground fault, the current flowing through the conductors 64 and 66 are equal and opposite, and no net flux is generated in the core 67A of the differential sense transformer 68A. In the event that a connection occurs between the line side of the AC load and ground, however, the current flowing through the conductors 64 and 66 no longer precisely cancel, and a net flux is generated in the core 67A of the differential sense transformer 68A. This flux gives rise to a potential at the output of the sense transformer 68A, and this output is applied to the input 150 of the GFCI chip 100 to produce a trip signal on the output line 102. The trip signal pulses the SCR's 51 gate, and is also detected via pin 112 of the microprocessor 104. The solenoid 50 is energized via the conducting SCR 51, which opens primary hot contact 45 and neutral contact 46 and face hot contact 47 and face neutral contact 48. Specifically, when the solenoid 50 is energized, the solenoid 50 moves the plunger 52 which moves the latching plate 54, thus, freeing the reset pin 56 and opening the contacts 45, 46, 47 and 48. The optocoupler 71 outputs a signal which is detected by the microcontroller 104 via pin 110. If the optocoupler's 71 signal is high, it indicates that primary hot contact 45 and primary neutral contact 46 are open. If the optocoupler's 71 signal is low, it indicates that both the primary hot contact 45 and primary neutral contact 46 are closed Primary hot contact 45 and neutral contact 46 and face hot contact 47 and face neutral contact 48 are in a closed state when the reset button 34 has been pressed and the solenoid 50 is deenergized. This state will be referred to as the normal state or closed state. However, after the solenoid 101 has been energized, the contacts 45, 46, 47 and 48 open. This state will be referred to as an open state.

In operation, a ground fault can occur via a manual or self-test, or an actual ground fault, for example when a person comes into contact with the line side of the AC load and an earth ground at the same time. In a manual test described in more detail below, a user presses test button 30. Test button 30 is connected between the hot conductor 66 and neutral conductor 64, which is a path that bypasses sense transformer 68A and ground transformer 68B. When the test button 30 is pressed, an imbalance is detected by sense transformer 68A because a path is established outside of the transformers 68A and 68B. Since there is no canceling current in the opposite direction, sense transformer 68A detects the current imbalance. As discussed above, the GFCI chip 100 detects a fault condition via transformers 68A and 68B. GFCI chip 100 communicates the fault condition via a trip signal on pin 102 to the microprocessor 104 via pin 112. Since the microprocessor 104 has no way of knowing whether a ground fault was triggered by an actual fault or by a manual fault simulated by pressing test button 30, the microprocessor 104 always reacts as if an actual fault condition has occurred.

The microprocessor 104 also does not know whether the actual fault has been removed until a user presses the reset button 34. If the fault is still present, the transformers 68A and 68B will detect the condition and GFCI chip 100 will reopen the contacts immediately as discussed above. If a manual test was performed, the fault will no longer be present and the GFCI device 10 returns to normal operation.

According to an embodiment of the present invention, a self test is performed on the fault detection and circuit tripping portions of the GFCI device 10. In this example, the self test is preferably performed in two stages, Test A and Test B, and preferably at 1 minute intervals. However, as will be appreciated by one skilled in the art, the microprocessor 104 can be programmed to perform testing at any interval of time. A continuity test is included with Test A. The continuity test is first performed on the solenoid 50. Specifically, during a positive half cycle of a sinusoid, the solenoid 50 conducts and charges capacitor C5. During the negative half cycle of the sinusoid, the capacitor C5 discharges. The discharge of capacitor C5 is detected by the microprocessor 104 via pin 118. If there is no discharge on capacitor C5, it indicates that the solenoid 50 is defective because the solenoid 50 did not allow capacitor C5 to charge. Thus, for the continuity test, the continuity of the solenoid is tested via the discharge of capacitor C5.

During Test A, the microprocessor 104 communicates a signal, which is preferably less than 2.0 ms to the transistor 70 via pin 106 on a negative half sinusoid near the middle of the half sinusoid. The transistor 70 is activated and provides a signal on conductor 69, which creates an imbalance in sensing transformer 68A. The imbalance is detected by GFCI chip 100, and the GFCI chip 100 provides a 0.5 ms trip signal on pin 102 which is detected by the microprocessor 104 via pin 112. Pin 112 of the microprocessor 104 is preferably an analog I/O. Resistor R5, which is in series with the pin 112 of the microprocessor 104, allows capacitor C2 to be monitored. Specifically, when the signal is output from pin 102 of the GFCI chip 100, the charge on capacitor C2 rises. The test signal is preferably short and completed during a negative half cycle of a sinusoid to prevent current in the sinusoid 50 and thereby avoid tripping the contacts 45, 46, 47 and 48. The microprocessor 104 detects the GFCI chip's trip signal in order to verify that the GFCI chip 100 is operating normally. It should be appreciated by those skilled in the art that the embodiment of the present invention can be practiced without the continuity test for Test A.

It should be noted that in an embodiment of the present invention, the I/O of microprocessor 104 preferably comprises a 10 bit I/O providing 3.2 mv per bit accuracy or 31 bits for 0.1 v. The sampling rate of the microprocessor 104 is ≈15 μs at an internal oscillator frequency of 4 MHz (8 Tosc) and 15 μs×31 bits=0.46 ms. The 2.5 k ohm minimum recommended analog source requirement is met since capacitor C2 has a low source resistance (ESR) and is charged by GFCI chip 100.

It should be noted that during Test A, if the GFCI chip 100 cannot provide an output signal to open the contacts 45, 46, 47 and 48, the microcontroller 104 will activate SCR 51 and energize the solenoid 50 to open the contacts 45, 46, 47 and 48. The user can reset the GFCI device 10 to restore power to the load terminals. However, the microcontroller 104 will no longer send a signal to open the contacts 45, 46, 47 and 48.

The second phase of self testing according to an embodiment of the present invention will now be discussed. The second phase is referred to herein as Test B. Test B tests the operability of SCR 51 and includes the test for the continuity of solenoid 50 via pin 118 of the microprocessor 104. Specifically, during a positive half cycle of a sinusoid, the solenoid 50 conducts and charges capacitor C5. During the negative half cycle of the sinusoid, the capacitor C5 discharges. The discharge of capacitor C5 is detected by the microprocessor 104 via pin 118. If there is no discharge on capacitor C5, it indicates that the solenoid 50 is defective because the solenoid 50 did not allow capacitor C5 to charge. Thus, for the continuity test, the continuity of the solenoid is tested via the discharge of capacitor C5. Next, the capacitor C2 is quick charged via a 0.5 ms pulse on pin 112 of the microprocessor 104. The 0.5 ms pulse is asserted high 12 ms after the zero crossing at the start of the positive half sinusoid. That is, Test B is initiated only on the negative half sinusoid. The charge on capacitor C2 activates SCR 51 about 0.4 ms from the zero crossing, which is far away from the energy necessary to open contacts 45, 46, 47 and 48. The microprocessor 104 will then detect via pin 118 whether capacitor C5 discharges through the SCR 51 in order to determine if the SCR 51 is operating normally. It should be appreciated by those skilled in the art that the embodiment of the present invention can be practiced without the continuity test for Test B.

In an embodiment of the present invention, if the GFCI device 10 determines that the one minute periodic test failed, the one minute test can be repeated, preferably eight times, and if the test fails each time, the GFCI device 10 can be declared as non- operational. As previously described, the red LED 44B will flash. In an embodiment of the present invention, the GFCI device 10 allows a user to reset the GFCI device 10 to function in an unprotected receptacle mode, if the GFCI device 10 is determined to be non-operational. The red LED 44B will then flash to indicate that the GFCI device 10 is not providing ground fault protection.

It should be noted that if the GFCI device 10 is determined to be nonfunctional, and operates in a receptacle mode of operation, the self tests are prevented from occurring. The microprocessor 104 flashes the red LED 44B via pin 108.

The power/alarm indicator 44invention will now be described. It should be noted that the GFCI chip 100 preferably includes a regulator that provides a dual function. One function is to power the internal circuitry of the GFCI chip 100. The second function is to power circuitry external to the GFCI chip 100 (such as Green LED 44A). The Green LED 44A illuminates during normal operation of the GFCI receptacle 10. The Red LED 44B is illuminated solid if contacts 45, 46, 47 and 48 have been tripped and the Green LED 44A is extinguished. However, the Red LED 44B flashes to indicate that the GFCI receptacle 10 is not providing ground fault protection if any of the self tests have failed.

Figure 10:
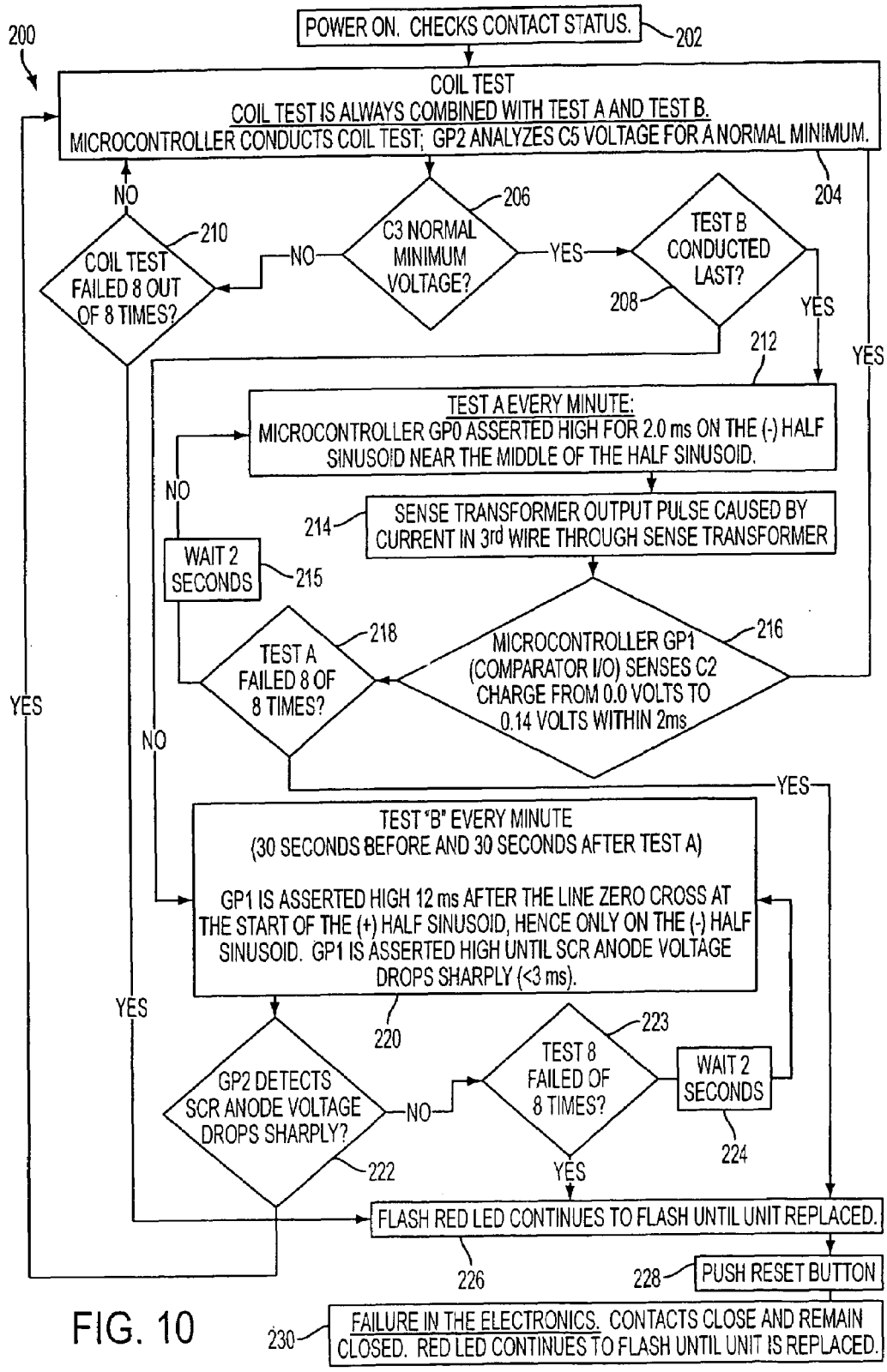
FIG. 10 is a flow chart of an example of a method of performing an automatic self test on the GFCI in accordance with an embodiment of the present invention.

FIG. 10 is a flow chart of an example of a method of performing an automatic self test on the GFCI in accordance with an embodiment of the present invention. The method 200 is initiated at step 202 where the GFCI receptacle 10 is powered on and the status of the primary hot and neutral contacts 45 and 46 is determined via pin 110 of the microprocessor 104. At step 204, a decision is made to initiate a self test. The self test is preferably performed in two stages or tests. Test A comprises testing sense transformer 68A and GFCI circuit 100. Test B comprises testing the SCR 51. An exemplary automatic self test is preferably performed once per minute. The self test preferably tests the solenoid 50 before each of Test A and Test B. However, it should be appreciated by those skilled in the art that a self test can be scheduled at any interval of time without departing from the scope of the present invention.

At step 206, a determination is made as to whether C5 is at a normal minimum voltage which indicates that solenoid 50 has continuity. Specifically, during a positive half cycle of a sinusoid, the solenoid 50 conducts and charges capacitor C5. During the negative half cycle of the sinusoid, the capacitor C5 discharges. The discharge of capacitor C5 is detected by the microprocessor 104 via pin 118. If there is no discharge on capacitor C5, it indicates that the solenoid 50 is defective because the solenoid 50 did not allow capacitor C5 to charge.

If the determination at step 206 is answered negatively, the method proceeds to step 210 where a determination is made as to whether the solenoid test failed 8 out of 8 times. If the determination at step 210 is answered affirmatively, the method proceeds to step 226. If the determination at step 210 is answered negatively, the method returns to step 204.

If the determination at step 206 is answered affirmatively, the method proceeds to step 208 where a determination is made as to whether Test B was conducted last. If test B was not conducted last, the method proceeds to step 220. If Test B was conducted last, the method proceeds to step 212 to perform Test A.

At step 212, Test A is performed. The microcontroller 104 is asserted high at pin 106 for about 1.5 ms near the middle of a negative half sinusoid of the line input 39, and preferably less than about 2.0 ms. The high signal on pin 106 turns transistor 70 on resulting in a signal on third wire 69. It should be noted that the SCR 51 anode capacitor C5 waveform is used to locate positive and negative half sinusoids and the middle of half sinusoids. Capacitor C5 voltage minimum occurs slightly after the true zero crossing during the negative half cycle. The microcontroller 104 preferably monitors the voltage C5 via pin 118, and may include software to calculate the actual zero crossing.

At step 214, the sense transformer 68A detects the pulse on third wire 69 as an imbalance and provides an imbalance indication to the GFCI chip 100. The GFCI chip 100 places a trip signal on pin 102 of the GFCI chip 100 which charges capacitor C2.

At step 216, a determination is made as to whether the microcontroller 104 detects capacitor C2 being charged from 0.0 volts to preferably 0.14 volts. The rise in capacitor C2 occurs preferably within 2 ms. If the determination at step 216, is answered affirmatively, the method returns to step 204.

If the determination at step 216 is answered negatively, the process proceeds to step 218 where a determination is made as to whether Test A, which tests the sense transformer 68A and GFCI chip 100, has failed 8 out of 8 times.

If the determination at step 218 is answered negatively, the process waits for 2 seconds at step 219 then returns to step 212. If the determination at step 218 is answered affirmatively, the process proceeds to step 226.

At step 220, Test B is performed every minute preferably 30 seconds before and 30 seconds after Test A is performed. The microcontroller 104 places a high signal on pin 112 of the microcontroller 104 after the zero crossing at the end of the positive half sinusoid, hence only on the negative half sinusoid. Pin 112 is maintained high until the SCR anode voltage drops sharply after 2 ms but no longer than 3 ms. When SCR 51 is conducting capacitor C5 can discharge rapidly through SCR 51 rather than through R15 and R16 which is a slow discharge. The method proceeds to step 222.

At step 222 a determination is made as to whether the microcontroller 104 detects a sharp drop in the SCR anode voltage at pin 118. That is the microcontroller 104 looks for the SCR anode voltage to drop sharply to ground. Test B is performed during the negative half cycle when the solenoid 50 advantageously cannot be tripped.

If the determination at step 222 is answered affirmatively, Test B has passed and the method returns to step 204. If the determination at step 222 is answered negatively, the process proceeds to step 224 where a determination is made as to whether Test "B" has failed 8 out of 8 times. If Test B has failed eight times, the method proceeds to step 226.

At step 226, the microcontroller 104 flashes the red LED 42B permanently via pin 108 if Test "A" or "B" failed 8 out of 8 times. The flashing of the red LED 42B provides an alarm indication to a user that GFCI 10 is nonfunctional and has reached its End Of Life (EOL). If Test "A" fails and the failure of the GFCI 10 prevents the GFCI chip 100 from providing an output on pin 102 to open the contacts, the microcontroller 104 provides a signal to activate SCR 51 and open the primary hot and neutral contacts 45 and 46. It should be noted that the user is not permanently locked-out. The user is still able to reset GFCI 10 to restore power. However, the microcontroller 104 will no longer conduct self tests, and will not generate another signal to open the primary hot and neutral contacts 45 and 46. Manual tests, however, remain available to the user.

At step 228, the reset button 34 is pressed in order to reset the primary hot and neutral contacts 45 and 46 of the GFCI 10. At step 230, the red LED 42B continues to flash if the primary hot and neutral contacts 45 and 46 remain closed. The malfunctioning GFCI 10 should be replaced.

Figure 11:
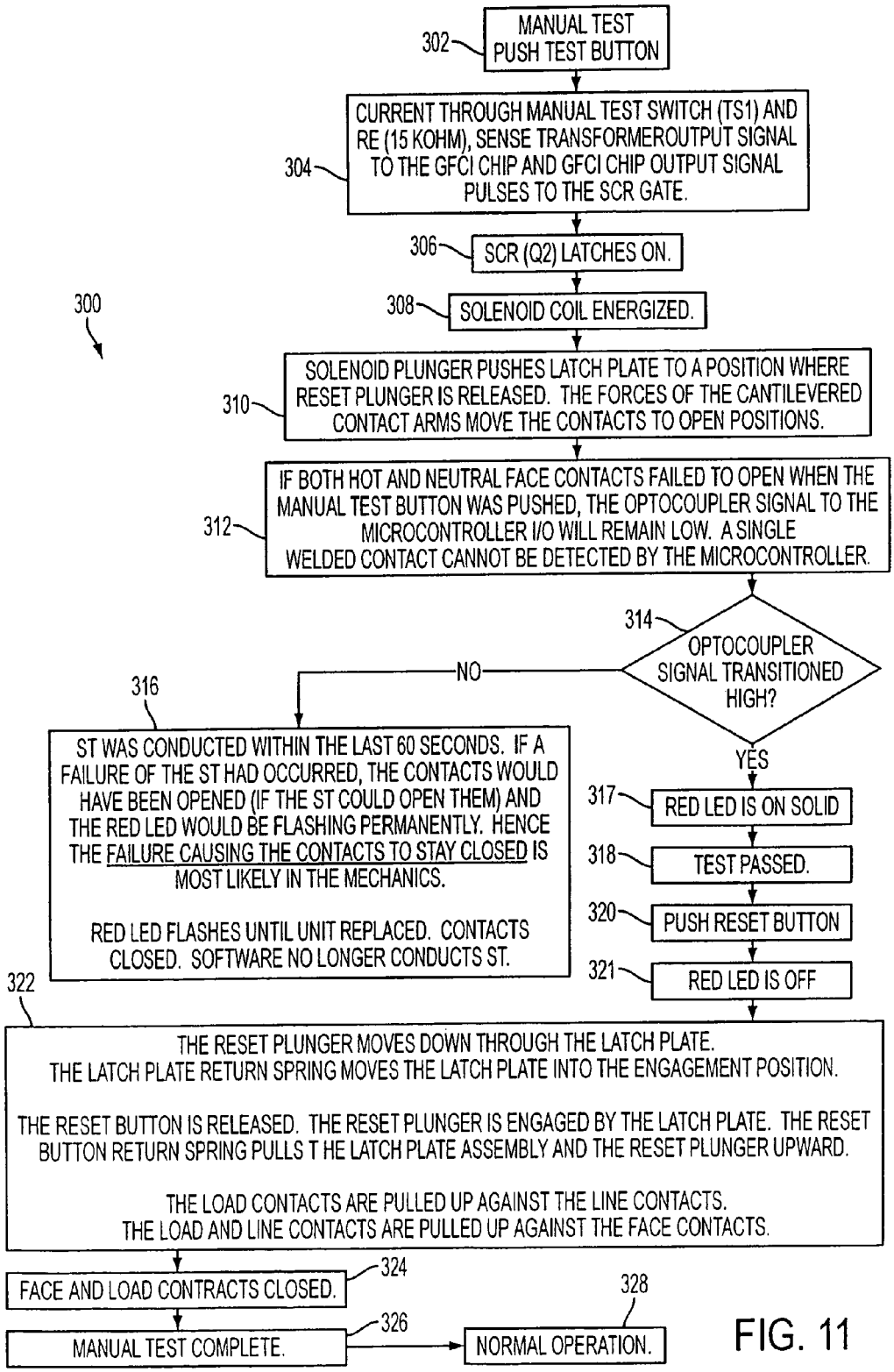
FIG. 11 is a flow chart of an example of a method of performing a manual test on the GFCI in accordance with an embodiment of the present invention.

FIG. 11 is a flow chart of an example of a method of performing a manual test on the GFCI in accordance with an embodiment of the present invention. The process 300 is initiated at step 302 where the test button 30 is pressed.

At step 304, the pressing of the test button causes an imbalance in the sense transformer 68A because the current from the line neutral flows through line 61. The sense transformer 68A communicates an imbalance signal to the GFCI chip 100, which places a trip signal on pin 102 of the GFCI chip 100.

At step 306, the trip signal activates the SCR 51, which results in the solenoid 50 being energized at step 308. The energization of the solenoid 50 results in the solenoid plunger 52 pushing the latch plate 54 to a position where the reset pin 56 is released. The force of the cantilevered contact arms then move the primary hot and neutral contacts 45 and 46 to an open position at step 310.

At step 312, if both the primary hot and neutral contacts 45 and 46 fail to open when the test button 30 is pressed, the optocoupler's 71 signal to the microcontroller 104 remains low. Thus, this embodiment of the present invention can detect dual welded contacts.

At step 314, a determination is made as to whether the optocoupler signal transitioned high indicating that the primary hot and neutral contacts 45 and 46 opened. If the determination at step 314 is answered negatively, the method proceeds to step 316 where the red LED 44B flashes until the GFCI 10 is replaced. Since the manual test has been performed and the primary hot and neutral contacts failed to open, the failure of the manual test is due to a problem affecting the mechanics of the GFCI 10. Thus, the self test is no longer performed. As with a failure of the self test, as described above, a failure of the manual test causes the Red LED 44B to flash until the unit is replaced. Self tests will no longer be performed and the unit operates in an unprotected receptacle mode until replaced.

If the determination at step 314 is answered affirmatively, the method proceeds to step 318 where the manual test passes once the primary hot and neutral contacts 45 and 46 open.

At step 320 the user presses the reset button 34. Then at steps 322 and 324, the reset pin 56 is then positioned through the latch plate 54 into a position of engagement. When the reset button 34 is released, the reset pin engages the latch plate 54. The reset button 34 return spring 35 pulls the latch plate assembly and the reset pin 56 upward. This results in the primary hot and neutral contacts 45 and 46 and the face hot and neutral contacts 47 and 48 closing.

The closing of the contacts results in the completion of the manual test at step 326. At step 328, the GFCI 10 returns to monitoring for ground faults and performing periodic self tests.

Figure 12:
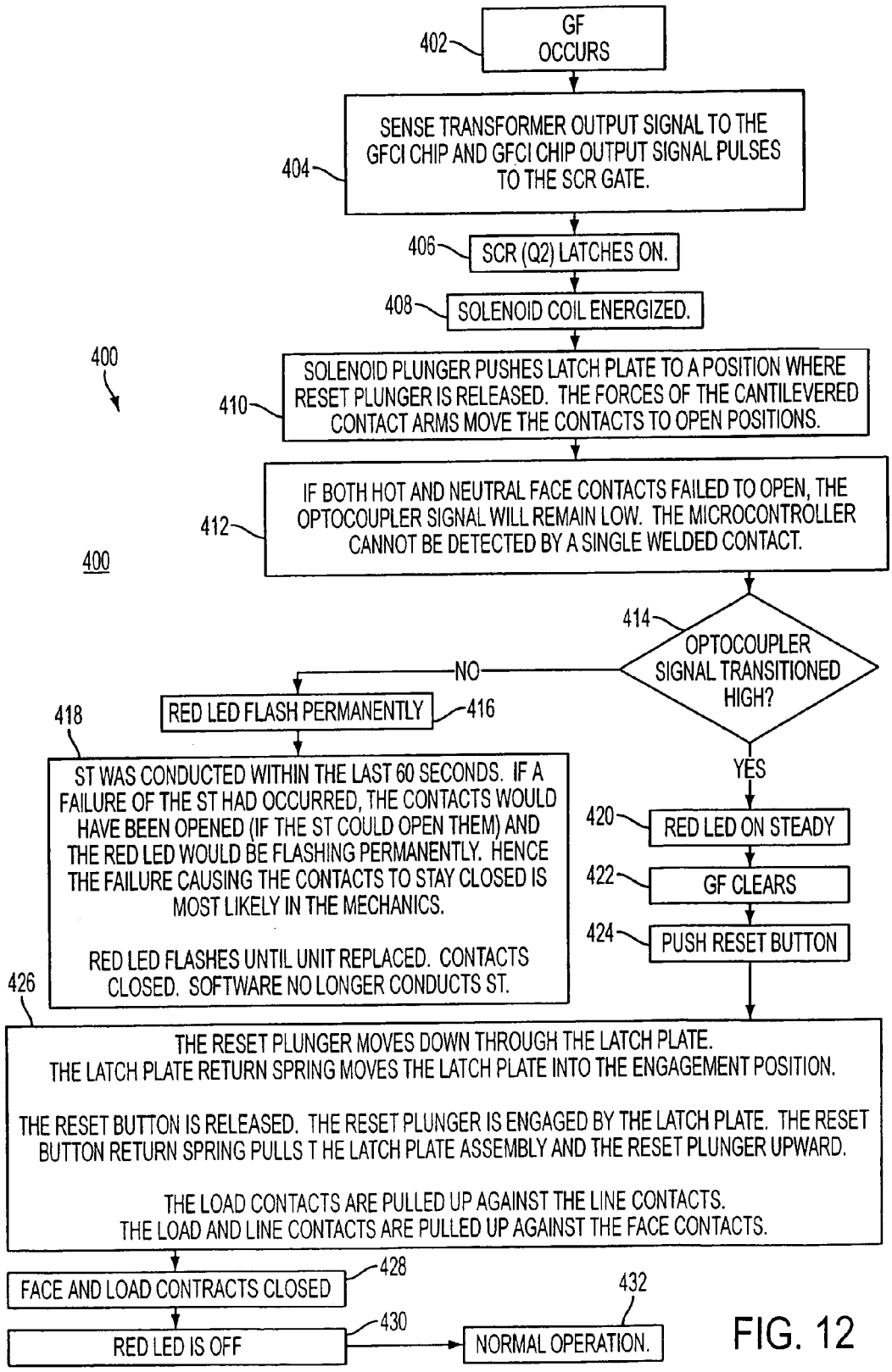
FIG. 12 is a flow chart of an example of a method of responding to an externally generated ground fault using the GFCI device in accordance with an embodiment of the present invention.

FIG. 12 is a flow chart of an example of a method of responding to an externally generated ground fault using the GFCI device in accordance with an embodiment of the present invention. The process 400 is initiated at step 402 when an actual ground fault occurs.

At step 404, the ground fault is detected via an imbalance in the sense transformer 68A because the current from the line neutral conductor 64 flows through the third wire 69. The sense transformer 68A communicates an imbalance signal to the GFCI chip 100, which places a trip signal on pin 102 of the GFCI chip 100.

At step 406, the trip signal activates the SCR 51, which results in the solenoid 50 being energized at step 408. The energization of the solenoid 50 results in the solenoid plunger 52 pushing the latch plate 54 to a position where the reset pin 56 is released. The force of the cantilevered contact arms then move the primary hot and neutral contacts 45 and 46 to an open position at step 410.

At step 412, if both the primary hot and neutral contacts 45 and 46 fail to open when the test button 34 is pressed, the optocoupler's 71 signal to the microcontroller 104 remains low. It should be noted that the embodiment of the present invention can detect dual welded contacts.

At step 414, a determination is made as to whether the optocoupler's 71 signal transitioned high indicating that the primary hot and neutral contacts 45 and 46 opened. If the determination at step 414 is answered negatively, the method proceeds to step 416 where the red LED 44B flashes permanently until the GFCI 10 is replaced. Since the self test has recently been performed and passed and the primary hot and neutral contacts 45 and 46 failed to open, the failure of the contacts to open is due to a problem affecting the mechanics of the GFCI 10. Thus, the self test is no longer performed at step 418, and the GFCI operates in a receptacle mode until replaced.

If the determination at step 414 is answered affirmatively, the method proceeds to step 420 where the red LED 44B is illuminated solid. This indicates that the primary hot and neutral contacts 45 and 46 and the face hot and face neutral contacts 47 and 48 have opened. The ground fault condition is cleared at step 422.

At step 424 the user presses the reset button 34. Then at steps 426 and 428, the reset pin 56 is then positioned through the latch plate 54 into a position of engagement. When the reset button 34 is released, the reset pin 56 engages the latch plate 54. The reset button 34 return spring 35 pulls the latch plate assembly and the rest pin 56 upward. This results in the primary hot and neutral contacts 45 and 46 and the face hot and face neutral contacts 47 and 48 closing.

At step 430, the closing of the contacts results in the primary hot and neutral contacts 45 and 46 and the face hot and face neutral contacts 47 and 48 closing and the red LED 44B being extinguished.

At step 322, the GFCI receptacle 10 returns to monitoring for ground fault conditions and performing periodic self tests.

Figure 13:
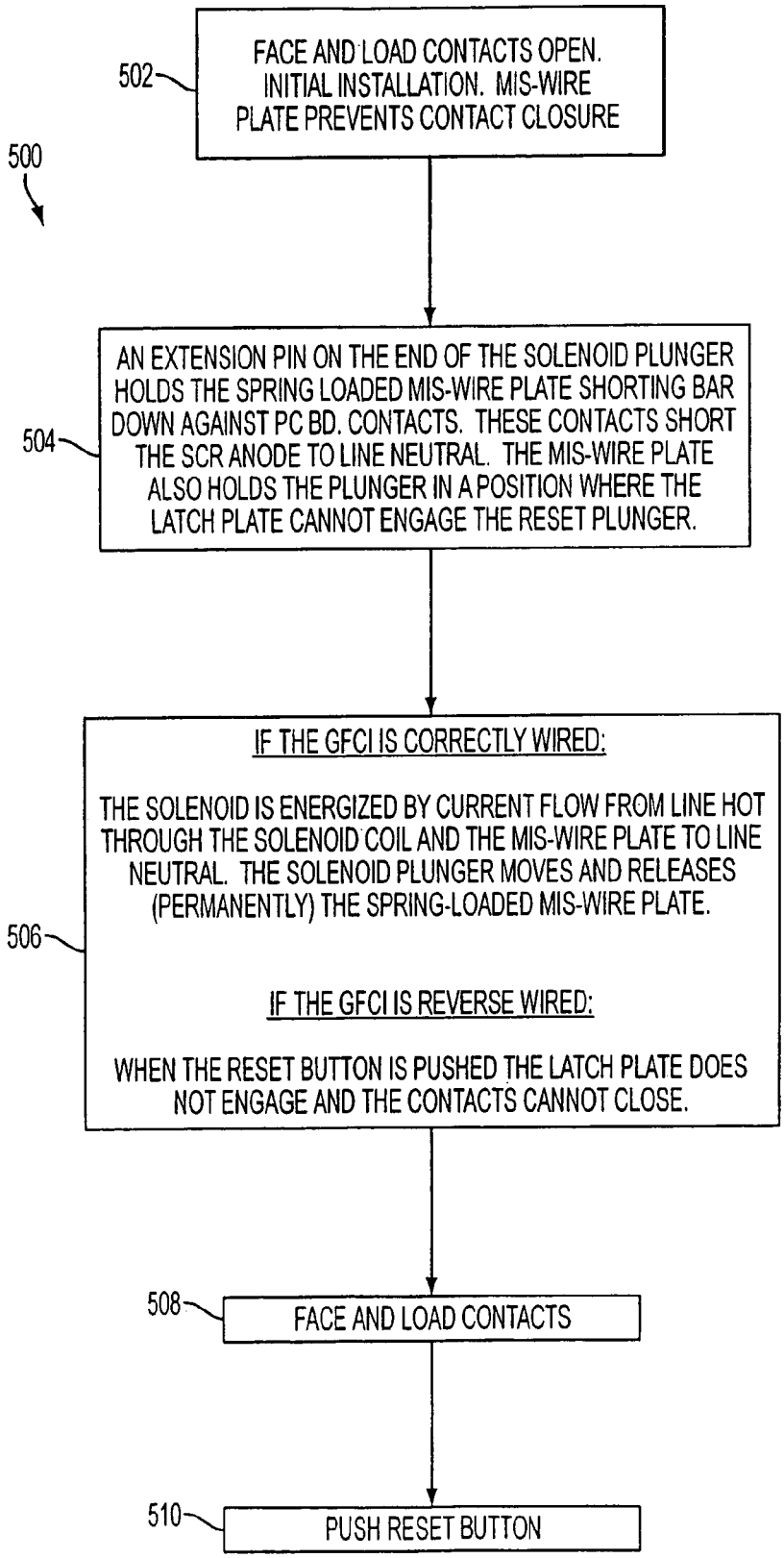
FIG. 13 is a flow chart of an example of a miswire prevention method using the GFCI device in accordance with an embodiment of the present invention.

FIG. 13 is a flow chart of a miswire prevention method using the GFCI device in accordance with an exemplary embodiment of the present invention. The method 500 is initiated at step 502 where the initial installation is being performed. Thus, the primary hot and neutral contacts 45 and 46 and the face hot and face neutral contacts 47 and 48 are open and cannot be closed due to the miswire plate 58 preventing the reset pin from engaging the latching plate. Therefore, the primary hot and neutral contacts 45 and 46 and the face hot and face neutral contacts 47 and 48 are prevented from closing if the GFCI receptacle 10 is miswired on the load side. As described above, the GFCI device is required to be wired upon initial installation from the line side in order for the solenoid 50 to be energized and remove the solenoid plunger 52 from engagement with the miswire plate 58.

At step 504, an extension pin on the solenoid plunger 52 holds the spring biased miswire plate 58 against the secondary contacts 62. The secondary contacts 62 short the SCR's 51 anode to line neutral 64. The miswire plate 58 also maintains solenoid plunger 52 in a position where the latch plate 54 cannot engage the reset pin 56.

At step 506, if the GFCI receptacle 10 is miswired on the load side, the solenoid 50 cannot be energized to displace the solenoid plunger 52. If the GFCI receptacle 10 is wired correctly, which is from the line side, the solenoid 50 is energized and displaces the solenoid plunger 52 releasing the miswire plate 58 permanently.

At step 508, the primary hot and neutral contacts 45 and 46 and the face hot and face neutral contacts 47 and 48 are still open but are closed when the reset button 34 is depressed at step 510.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed is:

1. A self testing fault detector having a line side adapted to receive a sinusoidal input signal, a load side adapted for connection to a load and a conductive path there between, said apparatus comprising:

a controller, adapted to perform periodic self tests to determine a status of a protection circuit of said self testing fault detector without interrupting power to said load side; and a capacitor having a terminal connected between a solenoid and a switching device of the protection circuit;

wherein the capacitor is charged through the solenoid during positive half-cycles of the input signal and discharges at a first rate when the switching device is on and at a second rate, different from the first rate, when the switching device is off, during negative half-cycles of the input signal; and wherein the controller detects operability of the protection circuit by detecting a discharge of the capacitor at the first rate.

2. The self testing fault detector of claim 1, wherein said controller is further adapted to cause an imbalance in a ground fault detection circuit and detect an output signal of a ground fault circuit interrupter (GFCI) chip.

3. The self testing fault detector of claim 2, wherein said controller is adapted cause said imbalance only during negative half cycles of said sinusoidal input signal.

4. The self testing fault detector of claim 2, wherein said controller determines that said self testing fault detector is faulty if said output signal of said GFCI is not detected by said controller.

5. The self testing fault detector of claim 1, wherein said switching device comprises a Silicon Controlled Rectifier (SCR).

6. The self testing fault detector of claim 1, wherein said SCR is adapted to energize a solenoid when activated during positive half cycles of said sinusoidal input signal.

7. The self testing fault detector of claim 1, wherein said controller determines that the solenoid has continuity if the controller detects that said capacitor is charged during a negative half cycle of said sinusoidal input signal.

8. The self testing fault detector of claim 1, wherein said periodic self tests are performed at one minute intervals.

9. The self testing fault detector of claim 1, wherein said controller activates the protection circuit if a signal from a ground fault circuit interrupter (GFCI) chip is not detected.

10. A method for performing a self test on a fault detector having a line side adapted to receive a sinusoidal input signal, and a load side adapted for connection to a load, and a conductive path there between, comprising:

performing periodic self tests to determine a status of a protection circuit of said self testing fault detector without interrupting power to said load side;

said self tests comprising detecting a discharge rate of a capacitor during a negative half-cycle of the input signal;

said capacitor being charged through a solenoid of the protection circuit during positive half-cycles of the input signal, and discharged at a first rate during the negative half-cycle of the input signal when a switching device is turned on, and discharged at a second rate, slower than the first rate, during the negative half-cycle of the input signal when the switching device is turned off.

11. The method of claim 10, further comprising:

causing an imbalance in a detection circuit and detecting an output signal of a ground fault circuit interrupter (GFCI) chip.

12. The method of claim 11, wherein the step of providing further comprising:

causing the imbalance only during negative half cycles of said sinusoidal input signal.

13. The method of claim 11, further comprising:

determining that said fault detector is faulty if said output signal of said GFCI chip is not detected.

14. The method of claim 10, further comprising:

activating the switching device and determining if a current flows in said switching device.

15. The method of claim 14, wherein said switching device comprises a Silicon Controlled Rectifier (SCR).

16. The method of claim 10, further comprising:

determining that a solenoid has continuity if a charge is detected in said capacitor during a negative half cycle of said sinusoidal input.

17. The method of claim 10, further comprising:

performing said periodic self tests at one minute intervals.

18. The method of claim 10, further comprising:

activating the protection circuit if a signal from a ground fault circuit interrupter (GFCI) chip is not detected.

19. A self testing fault detector having a line side and a load side and a conductive path there between, said apparatus comprising:

a solenoid, adapted to move a miswire prevention plate from a first position operable to prevent closure of at least one contact disposed in said conductive path, to a second position operable to allow closure of said at least one contact when said self testing fault detector is powered from the line side; and a processor, adapted to perform a periodic self test to determine a status of the self testing fault detector without interrupting power to the load side.

20. The self testing fault detector of claim 19, wherein said periodic test comprises testing at least one of a GFCI chip, a solenoid, and a switch.

21. The self testing fault detector of claim 20, wherein said first switch comprises a silicon controlled rectifier (SCR).

22. The self testing fault detector of claim 21, wherein said controller opens said at least one contact by signaling said SCR if a GFCI chip fails to open said at least one contact.

23. The self testing fault detector of claim 22, wherein said at least one contact is resettable to provide electrical continuity for said self testing fault detector.

24. The self testing fault detector of claim 19, further comprising a ground fault circuit interrupter (GFCI) chip adapted to open at least one contact if a ground fault is detected.

25. The self testing fault detector of claim 24, wherein the GFCI chip energizes the solenoid to open the at least one contact.

26. The self testing fault detector of claim 19, wherein said periodic self test occurs at one minute intervals.

27. The self testing fault detector of claim 19, further comprises an alarm indicator.

28. The self testing fault detector of claim 27, wherein said alarm indicator comprises a green LED to indicate normal operation of said self testing fault detector.

29. The self testing fault detector of claim 27, wherein said alarm indicator comprises a red LED to indicate a fault.

30. The self testing fault detector of claim 29, wherein said red LED flashes upon failure of the self test and illuminates solid upon the opening of the at least one contact during a manual test or detection of an actual ground fault.

31. The self testing fault detector of claim 19, wherein said periodic self test occurs during a negative half cycle of a sinusoidal input signal.

* * * * *